United States Patent [19]

Adams

[11] 4,112,943

[45] Sep. 12, 1978

[54] THERAPEUTIC ASSEMBLY

[76] Inventor: Robbie J. Adams, Box 514A, Port Sulphur, La. 70083

[21] Appl. No.: 562,054

[22] Filed: Mar. 26, 1975

[51] Int. Cl.[2] ..... A61H 29/00

[52] U.S. Cl. ..... 128/24.1; 128/64; 128/400

[58] Field of Search ..... 128/24.1, 24.2, 64, 128/400, 401, 258, 32, 44

[56] References Cited

U.S. PATENT DOCUMENTS

| | | | |
|---|---|---|---|
| 1,177,388 | 3/1916 | Crane | 128/64 UX |
| 1,634,873 | 7/1927 | Homan | 128/64 |
| 1,636,568 | 7/1927 | Kennedy | 128/24.5 |
| 2,058,780 | 10/1936 | Elliott | 128/401 |
| 2,190,384 | 2/1940 | Newman | 128/400 |
| 2,730,104 | 1/1956 | Newman | 128/370 |
| 3,027,893 | 4/1962 | Darphin | 128/64 |
| 3,030,950 | 4/1962 | Forthun | 128/44 |
| 3,075,517 | 1/1963 | Morehead | 128/24.1 |
| 3,085,568 | 4/1963 | Whitesell | 128/24.1 |
| 3,419,923 | 1/1969 | Cowan | 5/348 |
| 3,548,809 | 12/1970 | Conti | 128/24 |
| 3,720,204 | 3/1973 | Wojtowicz | 128/64 |
| 3,760,800 | 9/1973 | Staffin et al. | 128/24.1 |

FOREIGN PATENT DOCUMENTS

| | | | |
|---|---|---|---|
| 25,094 | 2/1931 | Australia | 128/64 |

*Primary Examiner*—Lawrence W. Trapp

*Attorney, Agent, or Firm*—Cushman, Darby & Cushman

[57] ABSTRACT

An assembly for the treatment of muscle injuries and the like with heat and physical action. Liquid is circulated within a closed system from a tank having heating means therein, and pump, to a flexible bag member. Flow at the inlet of the bag member is restricted to increase the velocity (and momentum) of the liquid, and the heat and momentum of the liquid are transferred through the bag walls to the portion of an individual's body to be treated. The liquid is returned from the bag to the tank. The closed system is mounted on a carrier for ready transport thereof.

11 Claims, 5 Drawing Figures

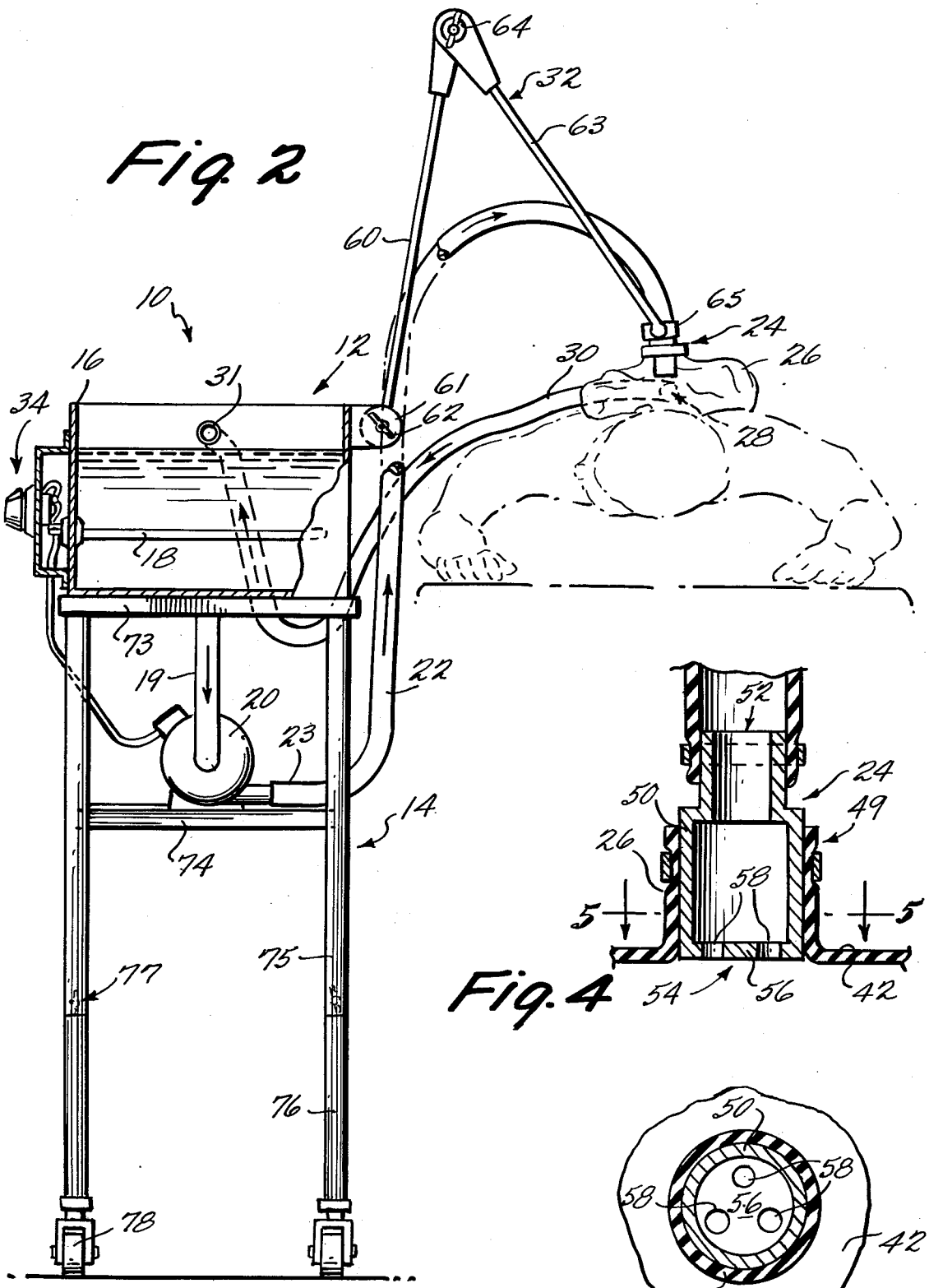
Fig. 2
Fig. 4
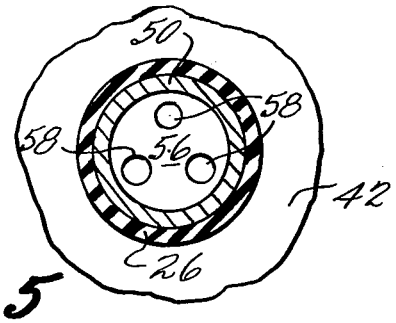
Fig. 5

THERAPEUTIC ASSEMBLY

BACKGROUND AND SUMMARY OF THE INVENTION

The invention relates to an assembly for the treatment of muscle injuries and the like by applying heat and physical action thereto. Conventionally, most physical injuries such as sprains, pulls, bruises, and the like of skeletal muscles, especially in the field of athletics, are treated in part by whirlpool baths. A conventional whirlpool bath is shown in U.S. Pat. No. 2,237,435. Treatment with such means results in a therapeutic effect by increasing circulation to the injured area by the thermal and physical effects of hot water impinging on the injured area.

While conventional whirlpool baths may provide proper treatment for an injured area, there are many problems associated therewith. They are very large and bulky, and are difficult to transport; therefore an athletic team traveling to an away game must rely on the facilities provided by their hosts, rather than being able to readily transport their facilities with them. A large volume of water is required for each "bath", resulting in a great deal of waste. If the injured area to be treated is the neck, back, or other inaccessible body part, the individual must immerse himself completely within the bath, rather than just treating the injured portion. This many times results in the individual fainting during or after treatment since it is desirable to have the water as hot as the individual can stand; and due to the danger of drowning, it is often required that someone always be present to assist the individual taking the bath.

According to the present invention, the above problems are overcome while proper treatment may still be effected. According to the present invention, a portable assembly is provided that allows for heat and physical treatment of injured areas of an individual's body without requiring an individual to immerse himself in a bath. Also, the body part to be treated may be elevated, thereby further increasing circulation, while treatment is being effected. A relatively small amount of water is required (about 1/5 that used in conventional whirlpool baths), which also means that less energy is required to heat the water to the desired temperature.

While in the past there have been several proposals for physical treatment of body parts with portable equipment with some heat treatment (see U.S. Pat. No. 3,720,204 and Australian Application No. 25,094/30 for example), or for heat treatment with some physical treatment (see U.S. Pat. No. 2,190,384 for example), it is not believed that any such prior art proposals would result in treatment for muscle injuries and the like that is as effective as conventional whirlpool treatment, while apparatus according to the present invention may be able to provide treatment that is as effective.

According to an important aspect of the present invention, the flow into a flexible bag member of a closed system is restricted so that increased velocity of the flow ensues. This results in an effective transfer of momentum through the walls of the flexible bag member to a body part.

It is the primary object of the present invention to provide a satisfactory substitute for a conventional whirlpool bath that is portable and does not require complete immersion of an individual in a bath for treatment. This and other objects of the present invention will be apparent from an inspection of the detailed description of the invention, and from the appended claims.

BRIEF DESCRIPTION OF THE DRAWINGS

FIG. 2 is a front view of the apparatus shown in FIG. 1 in use;

FIG. 4 is a cross-sectional detail view of the inlet of a flexible bag member of a closed circulatory system according to the present invention; and FIG. 5 is another cross-sectional view of the inlet shown in FIG. 4 taken along lines 5—5 of FIG. 4.

DETAILED DESCRIPTION OF THE INVENTION

Figure 3:
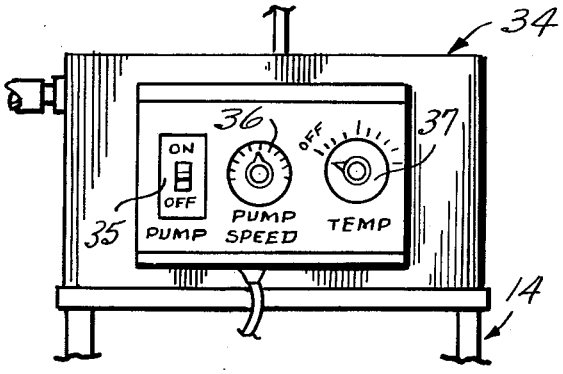
FIG. 3 is a detail view of a control panel for the apparatus shown in FIG. 2.
Figure 1:
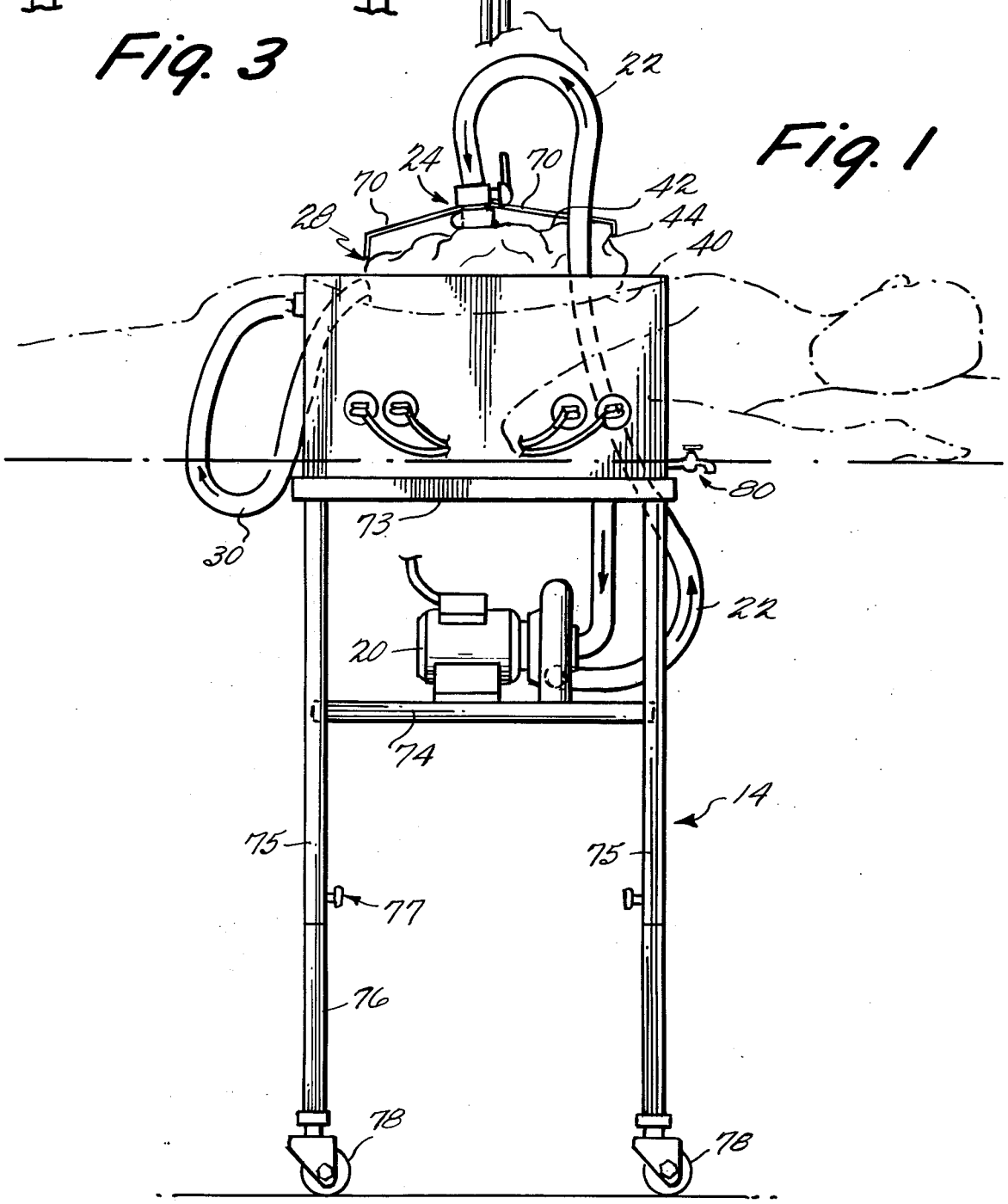
FIG. 1 is a side view of exemplary apparatus according to the present invention in use for treating an individual with a back injury.

An exemplary assembly according to the present invention is shown generally at 10 in the drawings. The assembly 10 comprises two general components, a closed circulatory system 12, and a carrier means 14. The closed circulatory system 12 is for circulating liquid having heat and momentum into therapeutic action on a body part of an individual. The system 12 generally comprises a tank 16 adapted to retain a quantity of liquid (i.e. water) therein, means for heating the liquid in the system, such as a heating element 18 extending into the interior of the tank 16, a pump 20 for providing the necessary force to circulate liquid within the system 12, a flexible hose member 22 for carrying liquid from the pump 20 to a flexible bag member 26, and a flexible hose member 30 for carrying liquid from the bag member 26 back to the tank 16.

The tank 16 may be made of any suitable material, and may be of any suitable size or shape. It is preferred, however, that the tank be of a size suitable for holding about 10 gallons of liquid for circulation in the system, so that it is readily portable yet holds a sufficient quantity of liquid for proper treatment. The heating means 18 may take any suitable form, such as an electric resistance heating element. Of course, sufficient precautions should be taken to insure that electrocution of individuals in the area will not occur, such as by providing an electrically insulating barrier (although not thermally insulating) between current carrying members in means 18 and the portions thereof in contact with the liquid in tank 16 and with tank 16 itself. The pump 20 too may be of any suitable construction.

Suitable control means may be provided for the pump 20 and the heating means 18, such as the control assembly shown at 34 in the drawings. The control means 34 may be attached to one of the side walls of tank 16, and may include an on-off control 35 for the pump 20, a pump speed control 36, and a temperature control 37. When the heating element is an electric resistance element, which is desirable, the member 37 controls the amount of current flowing thereto. The control means 34 may be connected —as by a wire— to any suitable energy source for powering pump 20 and heating means 18. The pump 20 too may be of any suitable construction.

The flexible hose member 22 is connected at one end 23 thereof to pump 20, and at the other end thereof to inlet 24 of flexible bag member 26. Preferably the connection 23 is releasable. The inlet 24 of the flexible bag member 26 is preferably at the "top" thereof — that is at that portion of the bag adapted to be placed on top during use thereof. The outlet 28 from the bag may be located at any position along the bag, however it is preferred that it be located at a portion of the bag spaced approximately 90° from the inlet 24. Hose 30 is connected at one end thereof to outlet 28, and at the other end 31 thereof to tank 16. Preferably the connection 31 is releasable, and preferably the connection 31 is located vertically far enough up the tank wall that it is above the level of the liquid in the tank 16 during use of the assembly.

The flexible bag member may be made of any material that is suitable for transferring the heat and momentum of liquid flowing through the bag to a body part of an individual. Suitable materials include, but are not limited to, rubber and polyethylene. It may be desirable to construct the top wall 42 of the bag 26 of relatively heavy material in order to provide strength and to facilitate connection to hoses 22 and 30 without failure or rupture thereof, however it is preferable that the bottom wall 40 of the bag 26 be constructed of relatively thin material in order to better transmit the heat and momentum of water circulating therethrough to a portion of an individual's body. It is also preferred that the outlet 28 from the bag be larger than the inlet 24 (and the discharge hose 30 be larger than the hose 22) so that there will be relatively little pressure in the bag. This facilitates circulation through the bag and also allows the bottom wall thereof to be constructed thinly without undue risk of failure.

At the inlet 24 of the bag member 26 there is provided a means 49 for restricting the flow passage from the hose 22 to the interior of the bag 26. Such means may take the form of a nozzle member. The nozzle member includes a generally tubular body portion 50 having an open end 52, and a restricted end 54 thereof. The restricted end 54 located interiorly of the bag 26 preferably includes a wall member 56 having a plurality of passages 58 therein. As shown in the drawings, there may be three passages 58 located at the vertices of an equilateral triangle. The passages must provide a restricted enough flow so that the velocity and turbulence of the flowing liquid is increased so that the momentum of the flow thereof transferred through the walls of the bag 26 is increased, but must not restrict the flow so much that the turbulence will be localized near the passages 58 and the mass of the flow substantially decreased [whereby increased momentum delivered through the bottom wall 40 would not be facilitated].

Adjustable supporting arm means, shown generally at 32 in the drawings, may also be provided as a part of the assembly 10. The supporting arm means 32 are for supporting the flexible bag 26 so that fatigue thereof as a result of the weight thereof and force of liquid therein, will be minimized, and also for holding the bag 26 in place once it has been positioned on a particular portion of an individual's body. The supporting means 32 may comprise a first arm 60 connected at one end thereof at 61 to the tank 16, and connected at the other end thereof to a second arm 63. The connection at 61 is pivotal and detachable, and a wing nut 62 or the like may be provided for providing an adjustable amount of force for retaining the arm 60 in a position to which it has been moved, and possibly for providing ready detachment of the arm 60 from the tank 16. A wing nut 64 or the like may be provided at the pivotal connection between arms 60 and 63 for the same purpose as the wing nut 62. The arm 63 is connected at the end thereof opposite its connection to arm 60 to a collar 65 surrounding the inlet hose 22, adjacent the bag inlet 24. The connection between arm 63 and collar 65 also preferably is pivotal. It may thus be seen that by adjustment of the members 61 and 64, the arm members 60, 63 may maintain the bag 26 in any position to which it is moved.

In addition to supporting arms 60, 63 additional means may be provided for supporting the bag member 26. Such additional means may take the form of arms 70 or the like extending from a point of connection to the hose 22 to the circumferential portions 44 of the bag 26, for holding the bag 26 in a relatively expanded condition, thereby facilitating therapeutic treatment with the assembly 10.

In order to provide for ready transport of the system 12 for treatment of individuals, the system is mounted on carrier means 14 or the like. The carrier means 14 may comprise a first surface portion 73 for supporting the tank 16 and related structures thereon, a second surface portion 74 located below and spaced from the first surface portion 73, the portion 74 supporting the pump 20 thereon, and a plurality (i.e., four) legs 75 extending downwardly from and interconnecting the surface portions 73, 74. The legs 75 may have lower portions 76 thereof which are adjustably connected as at 77 to the upper parts thereof, and at the bottom thereof to rollers or wheels 78 or the like. The carrier means 14 may be moved around on rollers 78, and the height thereof may be adjusted by adjusting the length of leg portions 76 extending from the upper portions of legs 75.

Another preferred feature of the present invention that facilitates portability thereof is the ability to detach all the parts thereof extending from the tank 16 and pump 20, and store them in the tank 16. For instance, the hoses 22 and 30 may be disconnected at ends 23 and 31 thereof from pump 20 and tank 16 respectively, and the supporting means 32 may be disconnected at 61 thereof from tank 16, or at collar 65 thereof from the inlet 24. The hoses 22, 30 and bag 26 may then be readily stored in the tank 16 for transport, and the means 32 either stored in the tank 16 or bent over the top thereof into engagement therewith. A very compact unitary structure that is easy to transport is then provided. Of course suitable cover means (not shown) may be provided for the tank 16, or the assembly 10 as a whole, during transport thereof.

Operation of the assembly 10 according to the present invention is as follows: The carrier 14 is wheeled into place adjacent an individual to be treated, or suitable treatment area, and the hoses 22 and 30 are properly connected up to tank 16, pump 20, and bag 26, and the supporting means 32 are properly connected to tank 16 and collar 65. The tank is then filled with liquid (i.e., water) and circulation thereof through the system 14 is effected by starting pump 20. The water may be at any temperature, however to speed up effective operation of the assembly, the liquid should be relatively hot. Operation of heating means 18 is also effected to maintain or increase the temperature of the liquid to the desired level.

After proper circulation of liquid at the right temperature is started through system 12, the bag 26 is placed on the portion of a person's body to be treated, and the bag 26 may be held in place with supporting means 32 and arms 70 if desired. Liquid flows from tank 16 through pipe 19 to pump 20, whereupon it is pumped into bag 26 through inlet 24 thereof. At inlet 44, nozzle 49 restricts the flow thereof, resulting in increased velocity and transfer of momentum through the bottom wall 40 of the bag 26 to the desired portion of the individual's body. Since outlet 28 is larger than inlet 24, the pressure within the bag 26 is minimized. Liquid exiting through outlet 28 flows through hose 30 to connection 31 of tank 16, and back into tank 16. Once the liquid within the system is heated to a desired temperature little heat need be added by the heating means 18 since there will be little heat loss from the system 12. When treatment is completed, the liquid may be drained from the tank 16 (as through spigot 80, the hoses 22 and 30 disconnected, and stored with the bag 26 within the tank 16, the legs 75, 76 may be shortened, the assembly 10 ready for transport to another location.

While the invention has been herein shown and described in what is presently conceived to be the most practical and preferred embodiment, it will be obvious to one of ordinary skill in the art that many modifications may be made thereof within the scope of the invention, which scope is not to be limited except by the appended claims.

What is claimed is:

1. A portable assembly for heat-treating and massaging body parts comprising:

(a) a closed system for circulating heated liquid having momentum to any desired body part of a patient, said system comprising:

(i) A tank adapted to contain a volume of liquid therein, (ii) a pump for circulating liquid in said system, (iii) means for heating the liquid in said system, (iv) a flexible bag member for transmitting the heat and momentum of liquid circulating through said system to a body part, said bag having an inlet and an outlet thereof, said outlet being larger than said inlet, (v) first flexible hose means for circulating liquid from said pump to said bag inlet, (vi) means for restricting a flow passage from said first flexible hose means to said bag at said bag inlet so that the velocity of liquid within said bag will be increased over the velocity within said first flexible hose, and the momentum thereof transferable through the walls of the bag increased, said means comprising a nozzle, (vii) second flexible hose means for returning fluid from said bag outlet to said tank, and (b) carrier means for mounting said closed system for ready movement thereof.

2. An assembly as recited in claim 1 further comprising adjustable supporting arm means attached to said first flexible hose means adjacent said bag inlet for supporting said flexible bag member for movement thereof.

3. An assembly as recited in claim 1 wherein said nozzle includes a tubular member having an open first end thereof connected to said first flexible hose, and a second end thereof having a wall disposed at the interior of said flexible bag member, said wall having three holes formed therein at the vertices of an equilateral triangle.

4. An assembly as recited in claim 1 wherein said carrier means includes a cart having first and second supporting surfaces thereof, said first surface located vertically above said second surface, and a plurality of legs extending downwardly from said surfaces, and wherein rollers are provided on the bottom of said legs.

5. An assembly as recited in claim 4 wherein said legs are adjustable in length.

6. An assembly as recited in claim 4 wherein said tank is supported by said first surface, and said pump is supported by said second surface.

7. An assembly as recited in claim 6 further comprising adjustable supporting arm means extending from said tank to said flexible bag member for supporting said flexible bag member, and wherein said flexible hoses are detachable from the elements to which they are connected so that all the elements of said closed system besides said pump may be placed in said tank for transport of said assembly.

8. An assembly as recited in claim 1 wherein said closed system further comprises control means for said pump and said heating means located on said tank, said control means comprising a pump speed control and a heating means temperature control.

9. An assembly as recited in claim 1 further comprising a plurality of arms extending from said bag inlet exterior of said bag to circumferential portions of said bag for supporting said bag in a generally extended condition.

10. An assembly as recited in claim 1 wherein said flexible bag member comprises a member having a relatively thick top wall for the connection of said inlet thereto, and a relatively thin bottom wall for increased transfer of the momentum and heat of said liquid to body heat.

11. An assembly as recited in claim 1 wherein said outlet is located at a position spaced 90° from said inlet.

* * * * *